US005379737A

United States Patent [19]

Hu

[11] Patent Number: 5,379,737

[45] Date of Patent: Jan. 10, 1995

[54] ELECTRICALLY CONTROLLED TIMING ADJUSTMENT FOR COMPRESSION RELEASE ENGINE BRAKES

[75] Inventor: Haoran Hu, Farmington, Conn.

[73] Assignee: Jacobs Brake Technology Corporation, Wilmington, Del.

[21] Appl. No.: 112,771

[22] Filed: Aug. 26, 1993

[51] Int. Cl.[6] ..... F02D 13/04

[52] U.S. Cl. ..... 123/322; 123/90.52

[58] Field of Search ..... 123/320, 321, 322, 90.52

[56] References Cited

U.S. PATENT DOCUMENTS 3,220,392 11/1965 Cummins ..... 123/320
4,398,510 8/1983 Custer ..... 123/90.16
4,399,787 8/1983 Cavanaugh ..... 123/321
5,201,290 4/1993 Hu ..... 123/321

*Primary Examiner*—Noah P. Kamen
*Attorney, Agent, or Firm*—Robert R. Jackson

[57] ABSTRACT

In a compression release engine brake, electrically controlled mechanisms are provided to partly selectively control the positions or motions of the engine brake slave pistons which periodically open the exhaust valves in the associated internal combustion engine when engine braking is desired. The electrically controlled mechanisms can be used for such purposes as controlling the "lash" of the engine brake or controlling the timing and duration of exhaust valve openings. Because these mechanisms are electrically controlled, they can be made to operate substantially instantaneously.

12 Claims, 7 Drawing Sheets

ELECTRICALLY CONTROLLED TIMING ADJUSTMENT FOR COMPRESSION RELEASE ENGINE BRAKES

BACKGROUND OF THE INVENTION

This invention relates to compression release engine brakes, and more particularly to apparatus for controlling, adjusting, or modifying the timing or other related characteristics of the operation of compression release engine brakes.

As shown, for example, in Cummins U.S. Pat. No. 3,220,392, a compression release engine brake or retarder may be mounted on an internal combustion engine to temporarily convert the engine from a power source to a power consuming gas compressor. An engine brake performs this function by using an appropriately timed mechanical input from one part of the engine to open an exhaust valve or valves in an engine cylinder which is nearing top dead center of its compression stroke. This allows the gas compressed in that cylinder to escape to the exhaust manifold of the engine, thereby preventing the engine from recovering the work of compression during the subsequent "power" stroke of the cylinder. (Of course, the fuel supply to the engine is typically turned off during operation of the engine brake.) In this way the engine brake helps to slow down or retard the engine and the vehicle propelled by the engine, thereby reducing the need to use the ordinary wheel brakes of the vehicle. This prolongs the life of the wheel brakes and increases vehicle safety.

In order to perform the function described above, a compression release engine brake typically includes hydraulic circuits for transferring the above-mentioned mechanical inputs to the exhaust valves to be opened. Each such hydraulic circuit has a master piston which is reciprocated in a master piston bore by the associated mechanical input from the engine. Hydraulic fluid in the circuit transmits the motion of the master piston to a slave piston in the circuit. Thus the slave piston reciprocates in a slave piston bore in response to the flow of hydraulic fluid in the circuit. The slave piston acts, either directly or through the exhaust valve opening mechanism of the engine, on the exhaust valve or valves to be opened, thereby opening the exhaust valve or valves at the appropriate times.

The timing of the exhaust valve openings described above is critical to the performance of the engine brake. Slight differences in timing can greatly affect the braking horsepower produced, as well as such other performance characteristics as the stress imposed on various components of the engine and engine brake. For example, delaying the initial opening of the exhaust valve until closer to top dead center of the compression stroke typically increases the engine braking available, but if the delay is too great, unacceptably large forces may be required to open the exhaust valves. As shown in Custer U.S. Pat. No. 4,398,510, hydraulic lash adjustors are known for controlling the gap between the slave piston and the associated exhaust valve mechanism for controlling this aspect of engine brake timing. While highly successful, these hydraulic lash adjustors may take several cycles of engine brake operation to become effective when the engine brake is turned on, and they may also take some time to deactivate after the engine brake is turned off. The initial delay in effectiveness may mean that full engine braking is not initially available, and the subsequent delay in deactivation may interfere with a few cycles of engine operation with fuel present in the engine cylinders. This latter operating characteristic can cause uncombusted fuel to be exhausted by the engine. This is both wasteful and environmentally undesirable.

Another respect in which it may be desirable to modify the timing or motion of the slave piston is to "clip" that motion as shown, for example, in Hu U.S. Pat. No. 5,201,290. This is typically accomplished by releasing some hydraulic fluid from the hydraulic circuit after a certain amount of motion of the slave piston has been produced. This may be desirable so that a strong hydraulic pulse from the master piston can be used to produce precisely timed exhaust valve opening, while the clipping action prevents excessive travel of the exhaust valve or undesirably prolonged opening of that valve. Excessive travel of the exhaust valve is to be avoided because it may result in contact between the exhaust valve and the associated piston. Prolonged opening of the exhaust valve may be undesirable because it may result in a back flow of gas from the exhaust manifold into the engine cylinder when the exhaust valve for another cylinder opens.

The known slave piston clipping mechanisms (e.g., as shown in the Hu patent mentioned above) are spring-loaded followers which travel with the slave piston until a follower stop is reached. Separation of the follower from the slave piston opens a passageway through which hydraulic fluid can escape from the circuit, thereby stopping the stroke of the slave piston.

Somewhat related slave piston "reset" mechanisms are shown in Cavanagh U.S. Pat. No. 4,399,787.

Again, clip valve and reset mechanisms such as those described above have been highly successful, but because they are passive they cannot perform all slave piston clipping or resetting functions that it would be desirable to perform in some cases. For example, it may be desirable to prolong exhaust valve openings at higher engine speeds. This would help to ensure that there is sufficient time for the compressed gas to escape from the engine cylinders, especially if the engine is turbocharged and the mass of gas in the cylinders is therefore higher at higher engine speeds when turbocharger effectiveness is greater. However, the known passive clip valve and reset mechanisms cannot produce different clipping or resetting effects at different engine speeds.

In view of the foregoing it is an object of this invention to provide improved compression release engine brakes.

It is another object of this invention to provide apparatus which can actively and substantially instantaneously affect the motion of the slave pistons in a compression release engine brake.

SUMMARY OF THE INVENTION

These and other objects of the invention are accomplished in accordance with the principles of the invention by providing a movable member in the slave piston bore of a compression release engine brake. The position of the movable member is at least partly controlled by electricity (e.g., by electric current flowing through a coil as in a solenoid). The movable member contacts or is removed from contact with the slave piston in order to influence the motion of the slave piston in the desired way, For example, the movable member can replace the known hydraulically operated lash adjusting mechanisms in order to provide lash adjustment which can be turned on and off substantially instantaneously by electrical control. Similarly, the electrically controlled movable member of this invention can replace the known clip valve or reset mechanisms, and because the position of the movable member is actively and instantaneously controlled, the clipping or resetting effect can be varied in any desired way (e.g., based on engine speed).

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
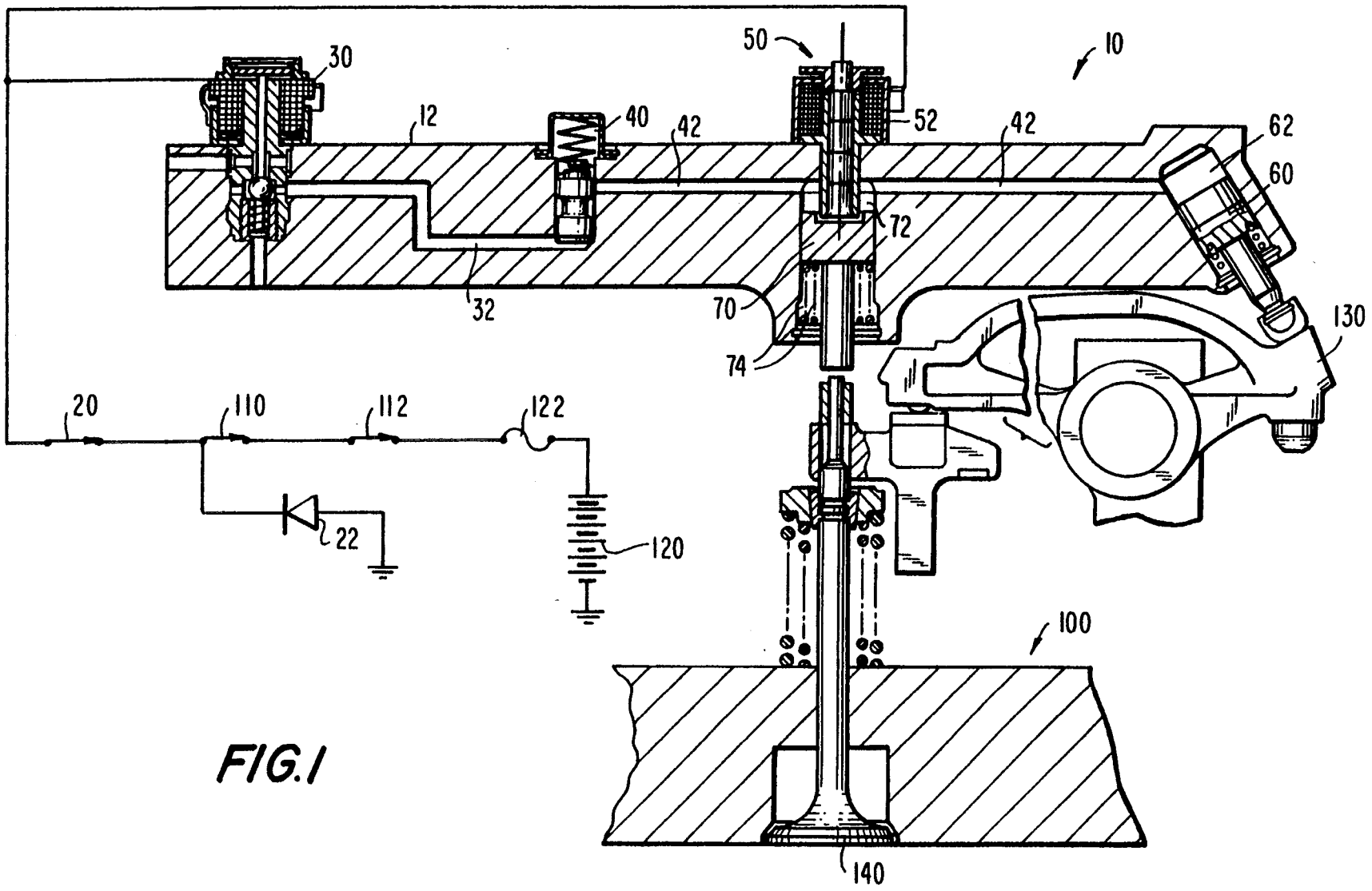
FIG. 1 is a simplified sectional view of a portion of an illustrative engine brake constructed in accordance with this invention. Some elements are shown schematically in FIG. 1, and portions of an internal combustion engine associated with the engine brake are also shown.

In the illustrative embodiment shown in FIG. 1, the apparatus of this invention is used to adjust the lash or gap between the slave piston and the portion of the exhaust valve opening drive train on which the slave piston acts. Engine brake 10 includes a housing which fits over the top of an associated internal combustion engine 100. When the engine brake is turned on by closing switch 20 (located, for example, on the dashboard of the vehicle propelled by engine 100), and assuming that engine fuel pump switch 110 and vehicle transmission clutch switch 112 are closed (indicating, respectively, that no fuel is being supplied to the engine and that the transmission clutch is engaged), electrical current flows from vehicle battery 120 through fuse 122, switches 112, 110, and 20 to solenoid valve 30 and the coil 52 of the electrically controlled timing apparatus 50 of this invention. Diode 22 is provided to help suppress undesirable electrical transients.

The above-described electrical energization of solenoid valve 30 causes that conventional valve to operate in the conventional way so that hydraulic pressure is maintained in relatively low pressure hydraulic circuit 32. Although relatively low, the pressure in circuit 32 is sufficient to operate conventional control valve 40 so that it traps hydraulic fluid in high pressure hydraulic circuit 42 in the conventional way. The pressure of the fluid thus trapped in circuit 42 is always at least substantially equal to the pressure of the fluid in circuit 32.

As is conventional, master piston 60 and slave piston 70 are both in contact with the hydraulic fluid in high pressure hydraulic circuit 42. This circuit includes the portion of master piston bore 62 above master piston 60 and the portion of slave piston bore 72 above slave piston 70. The initial pressure of the fluid in circuit 42 is sufficient to push master piston 60 out into contact with the portion of engine 10 (e.g., a fuel injector rocker arm 130) from which engine brake 10 obtains its mechanical input. Accordingly, once master piston 60 is thus in contact with rocker arm 130, each counter-clockwise oscillatory stroke of the rocker arm causes an upward reciprocatory stroke of master piston 60 in master piston bore 62. Hydraulic circuit 42 transmits this motion of master piston 60 to slave piston 70, thereby causing a downward reciprocatory stroke of the slave piston in slave piston bore 72. During this downward stroke, slave piston 70 contacts and pushes down elements in the drive train for exhaust valve 140. This causes exhaust valve 140 to open.

In order to ensure that slave piston 70 does not hold open exhaust valve 140 when the engine is hot and the various components of the engine and engine brake have accordingly expanded, a gap is typically left between slave piston 70 and the engine component on which the slave piston acts when the engine brake is on. To achieve the desired timing of exhaust valve openings during engine braking, however, it is typically desired to close some or all of that gap. As shown in the above-mentioned Custer patent, this may be accomplished by providing a lash adjusting member which is resiliently biased toward the top of the slave piston. A chamber behind the lash adjusting member can receive hydraulic fluid via a small hole in the member whenever the hole is not covered by the slave piston. During the first few forward strokes of the slave piston when the engine brake is turned on, the lash adjusting member gradually moves down and its chamber receives hydraulic fluid. A check valve substantially prevents fluid from escaping from the chamber. Accordingly, the lash adjusting member provides a new return stroke stop position for the slave piston, thereby reducing or eliminating the gap between the slave piston and the engine part on which that piston acts.

When the engine brake is turned off, hydraulic fluid gradually escapes from the chamber behind the lash adjusting member, thereby restoring the initial gap between the slave piston and the engine part on which it acts.

Figure 2:
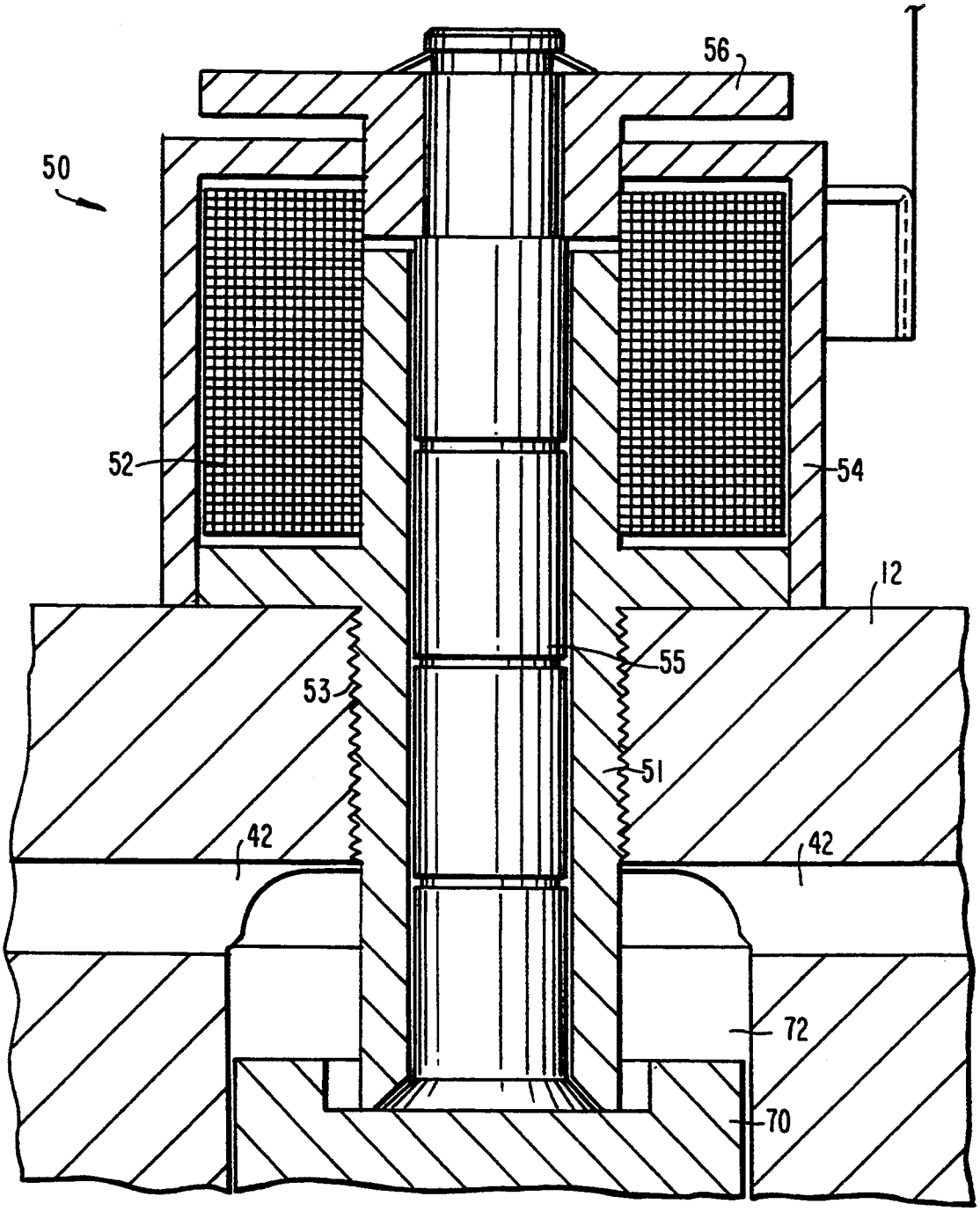
FIG. 2 is an enlargement of a portion of FIG. 1.

In accordance with the principles of this invention, the above-described lash adjusting mechanism is replaced by electrically operated lash adjusting mechanism 50. As shown on a larger scale in FIG. 2, mechanism 50 includes a hollow, substantially cylindrical main member 51 which is threaded at 53 into engine brake housing 12 so that the lower portion of member 51 extends into slave piston bore 72 above slave piston 70. The lower end of member 51 acts as a stop for the upward motion of slave piston 70 when the engine brake is off. (Slave piston 70 is resiliently biased upward by conventional slave piston return springs 74 shown in FIG. 1.) Note that the threaded mounting 53 of member 51 in housing 12 allows adjustment of the position of mechanism 50 relative to slave piston bore 72.

Electromagnetic coil 52 is wrapped around the upper portion of member 51 and is held in place by coil cover 54. Cylindrical member or rod 55 is disposed concentrically within member 51 and is vertically movable relative to member 51. An armature member 56 of ferromagnetic material is secured to the upper end of member 55. The lower end of member 55 rests on the top of slave piston 70.

When the engine brake is off, no current flows in coil 52. Accordingly, the return springs 74 of slave piston 70 push the slave piston up until it contacts the lower end of member 51. Members 55 and 56 are free to rise with slave piston 70 to the position shown in FIG. 2. This creates the relatively large gap between the slave piston and the exhaust valve drive train desired when the engine brake is off.

Figure 3:
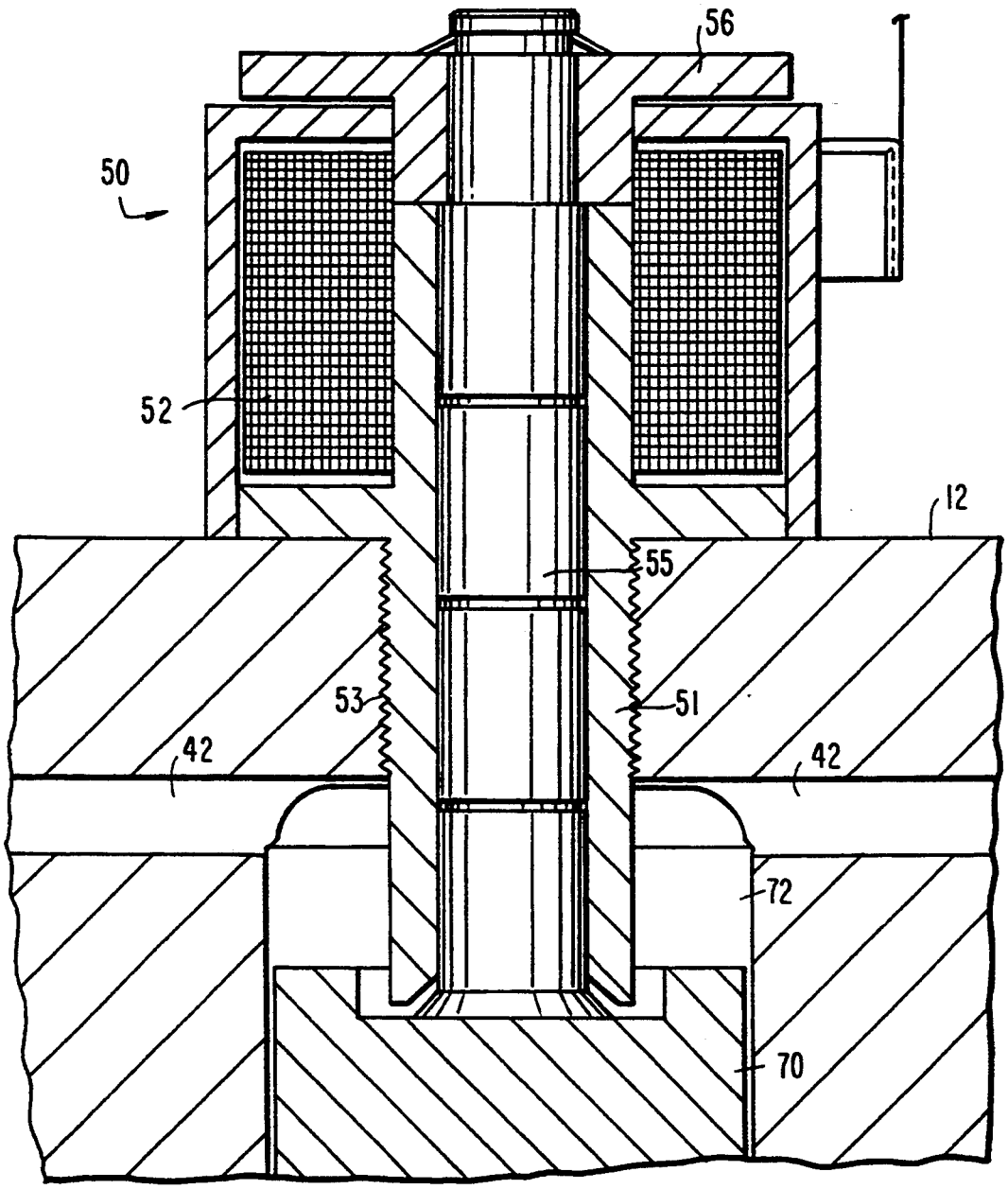
FIG. 3 is similar to FIG. 2, but shows another operating condition of the apparatus.

As soon as the engine brake is turned on, electrical current flows in coil 52. The resulting electromagnetic field pulls armature member 56 down to the position shown in FIG. 3. Member 55 moves down with the armature, thereby pushing slave piston 70 down and reducing or eliminating the gap between the slave piston and the associated exhaust valve drive train. Thereafter the engine brake operates as described above. The solenoid action of mechanism 50 is only required to be strong enough to overcome the return spring force of springs 74.

When engine braking is no longer desired, the engine brake is turned off and current flow in coil 52 ceases immediately. This allows mechanism 50 to immediately return to the condition shown in FIG. 2, thereby reestablishing the initial gap between slave piston 70 and the associated exhaust valve train.

From the foregoing it will be seen that mechanism 50 operates substantially instantaneously to adjust the lash of the engine brake. The above-described prior hydraulic lash adjusting mechanisms may require several cycles of engine brake operation to become fully effective or to return to their inoperative condition when the engine brake is turned on or off. Such operational delays are eliminated by the apparatus of this invention.

Figure 4:
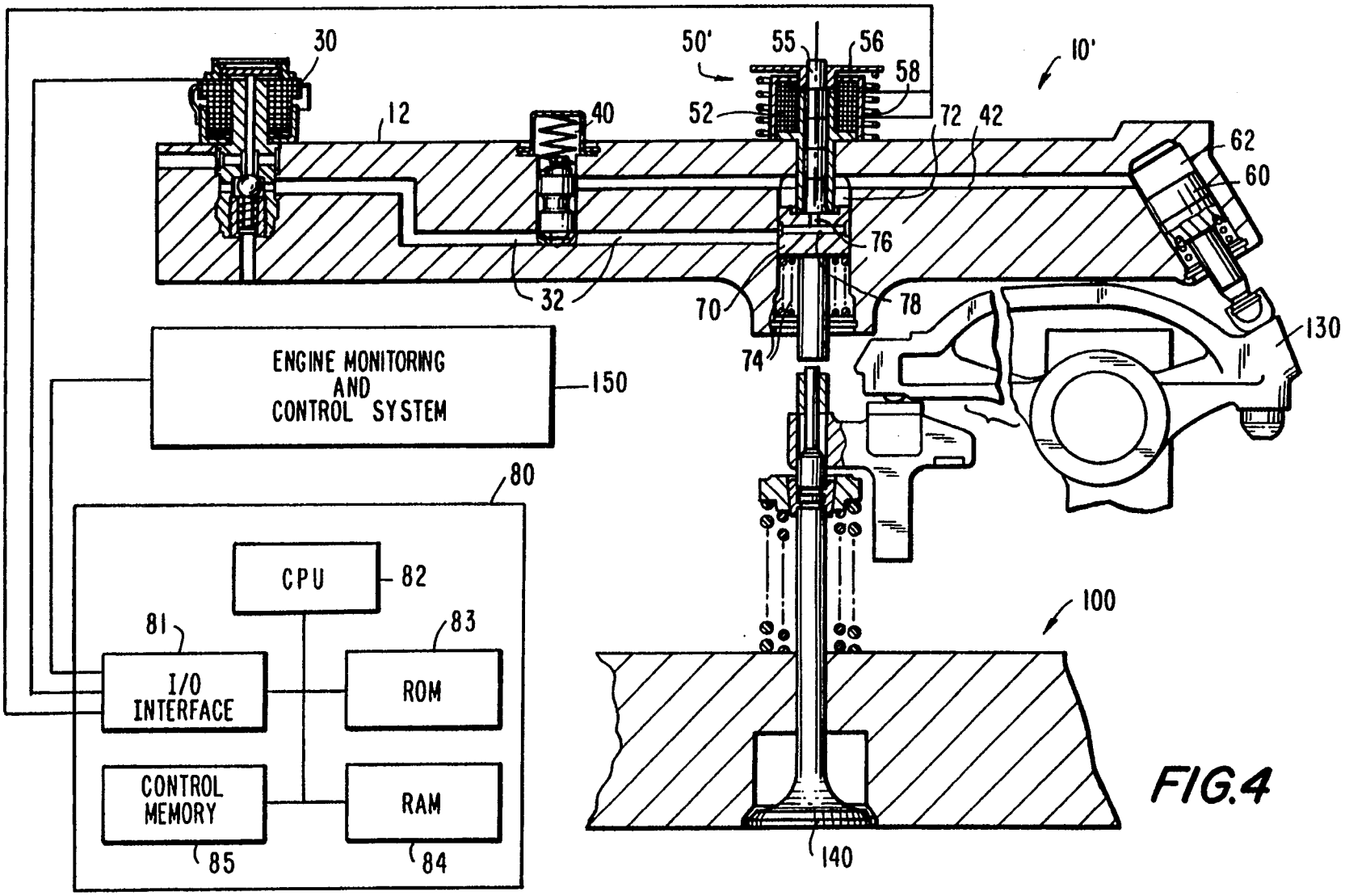
FIG. 4 is a view of the same general kind as FIG. 1, but shows an alternative embodiment of the invention.

FIG. 4 shows an alternative embodiment of the invention in which the electrically controlled timing mechanism 50′ performs a clip valve or reset function somewhat like that shown in the above-mentioned Hu and Cavanagh patents, but with additional capabilities described below. Engine brake 10′ in FIG. 4 is generally similar to previously described engine brake 10. In addition to the hydraulic circuitry described above, however, engine brake 10′ has the hydraulic circuitry required for clip valve or reset operation. In particular, a passageway or aperture 76 extends vertically down in the center of the upper portion of slave piston 70 to a passageway 78 which extends diametrically across the piston (see also FIGS. 5 and 6). Passageway 78 communicates with low pressure hydraulic circuit 32. The prior art clip valve mechanisms typically include a follower member which is disposed above passageway 76 and which is resiliently biased to follow slave piston 70 down for a predetermined distance. As long as the follower member is able to follow the slave piston down, it keeps passageway 76 covered and prevents hydraulic fluid from escaping from high pressure circuit 42. As soon as the follower member stops, however, passageway 76 is uncovered and hydraulic fluid can escape from high pressure circuit 42 to low pressure circuit 32 via passageways 76 and 78. This prevents further downward motion of slave piston 70. The downward resilient bias of the follower member is less than the upward bias of slave piston return springs 74. Thus when the mechanical input force is removed from master piston 60, slave piston return springs 74 return both slave piston 70 and its clip valve follower member.

Figure 5:
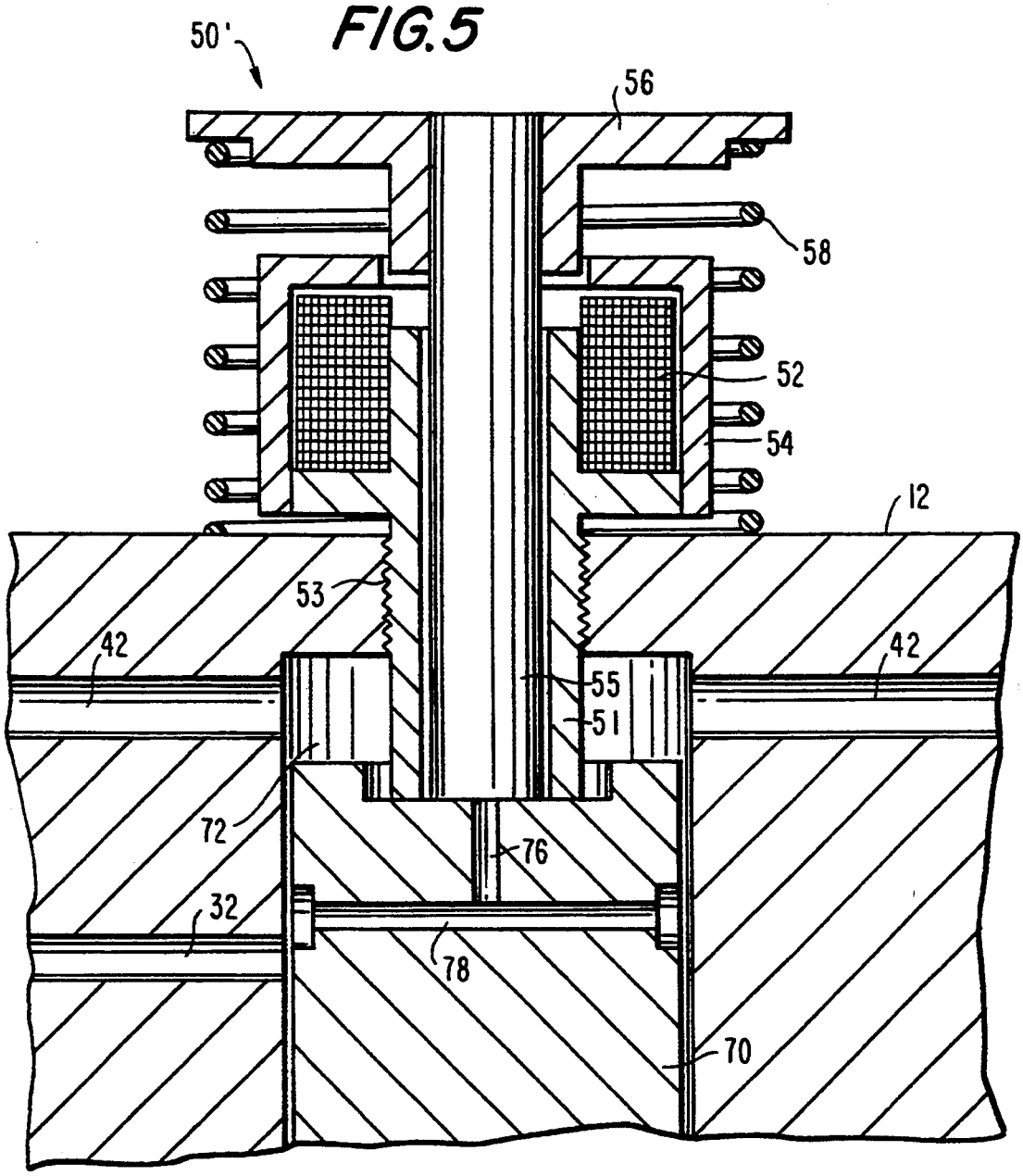
FIG. 5 is an enlargement of a portion of FIG. 4.
Figure 6:
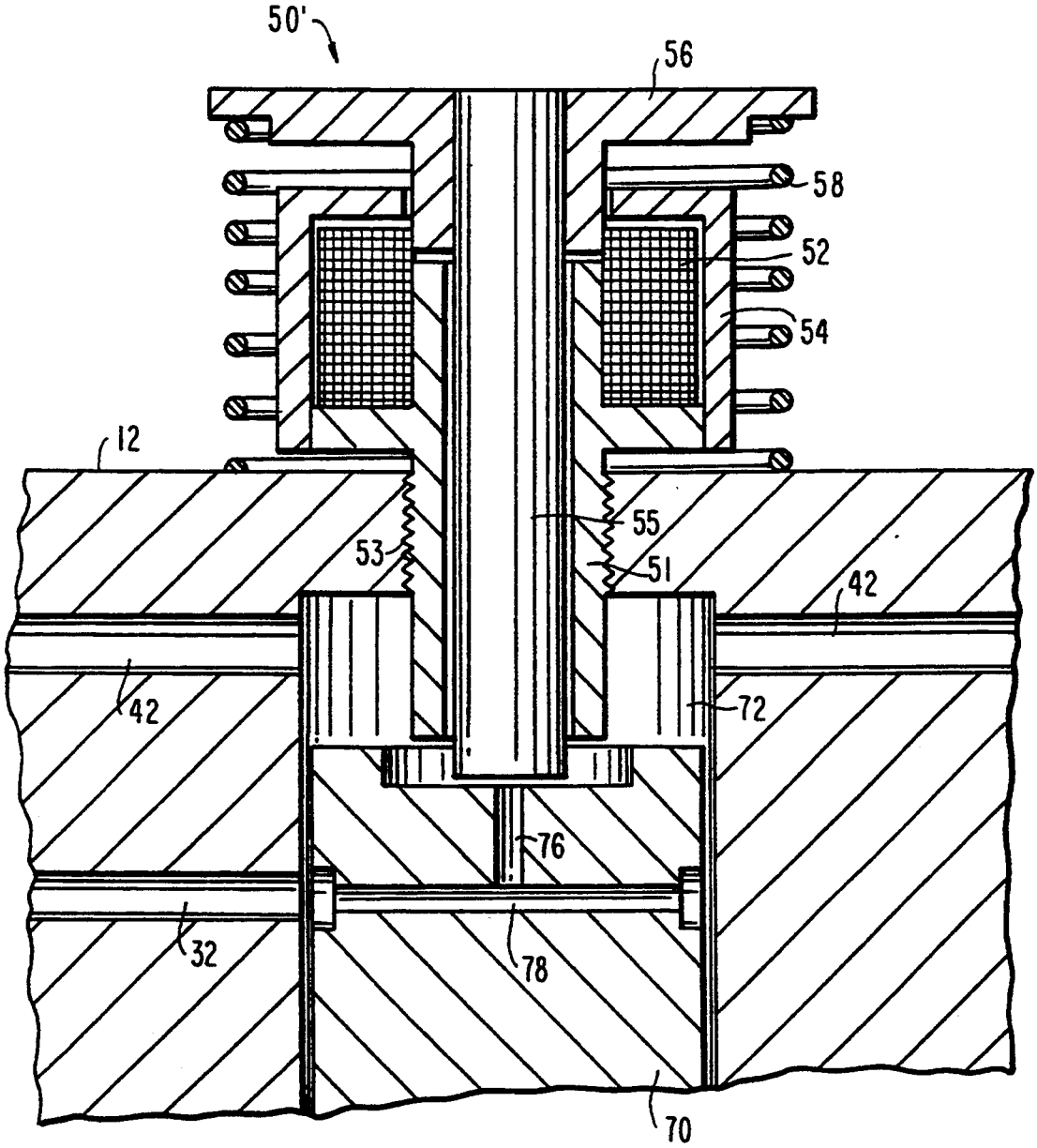
FIG. 6 is similar to FIG. 5, but shows another operating condition of the apparatus.

In the embodiment of the present invention shown in FIGS. 4–6, the movable member 55 of electrically controlled mechanism 50′ acts as the clip valve follower member. In the absence of electric current flow in coil 52, prestressed compression coil spring 58 holds member 55 up in the position shown in FIG. 5. When current flows in coil 52, however, armature 56 is electromagnetically attracted toward coil 52 by an electromagnetic force great enough to overcome the oppositely directed force of spring 58 and also great enough to cause member 58 to follow slave piston as it moves down in response to a hydraulically transmitted input from master piston 60. (In this embodiment, however, the electromagnetic force is not great enough to overcome the combined return spring force of springs 58 and 74.) Member 55 therefore keeps passageway 76 sealed and prevents hydraulic fluid from escaping from high pressure circuit 42. When slave piston 70 reaches the position shown in FIG. 6, further downward movement of member 55 is prevented by contact between central member 51 and armature member 56. Thereafter, any substantial further downward movement of slave piston 70 is prevented by the uncovering of passageway 76 and the consequent escape of hydraulic fluid via passageways 76, 78, and 32.

As compared to the prior art clip valve or reset mechanisms described earlier, the electrically controlled clip valve or reset mechanism 50′ of this invention has the advantage that whenever the flow of current through coil 52 stops, spring 58 retracts member 55. This vents high pressure hydraulic circuit 42 and allows slave piston return springs 74 to retract slave piston 70 regardless of the position of master piston 60. In other words, an exhaust valve opening can be terminated at any time just by turning off the current to coil 52. As mentioned in the Background section of this specification, it may be desirable to terminate exhaust valve openings at different times (i.e., at different engine crank angles) depending on the speed of the engine. This can be accomplished with the clip valve or reset mechanisms 50′ of this invention, and FIG. 4 shows additional control apparatus 80 that can be used in accordance with this invention to operate engine brake 10′ in this way.

As shown in FIG. 4, engine 100 has a conventional monitoring and control system 150 which produces output signals from which engine speed and crank angle can be derived. These signals are applied to the input/output interface 81 of the engine brake controller 80 of this invention. Controller 80 is controlled by a suitably programmed conventional microprocessor 82. Controller 80 also includes conventional read-only memory 83 for storing such fixed data as the program performed by the microprocessor and certain general system initialization constants. Controller 80 further includes conventional random-access memory 84 for temporary storage and retrieval of data by microprocessor 82. Control memory 85 may also be provided for storing control parameters unique to the particular engine or type of engine with which engine brake 10′ is being used. Controller 80 can be programmed to control clip valve or reset mechanisms 50′ in any desired way. For example, as engine monitoring and control system 150 indicates that the speed of engine 100 is increasing, controller 80 can turn off the current to each mechanism 50′ at a later engine crank angle for that mechanism, thereby advantageously prolonging exhaust valve openings as engine speed increases.

Figure 7:
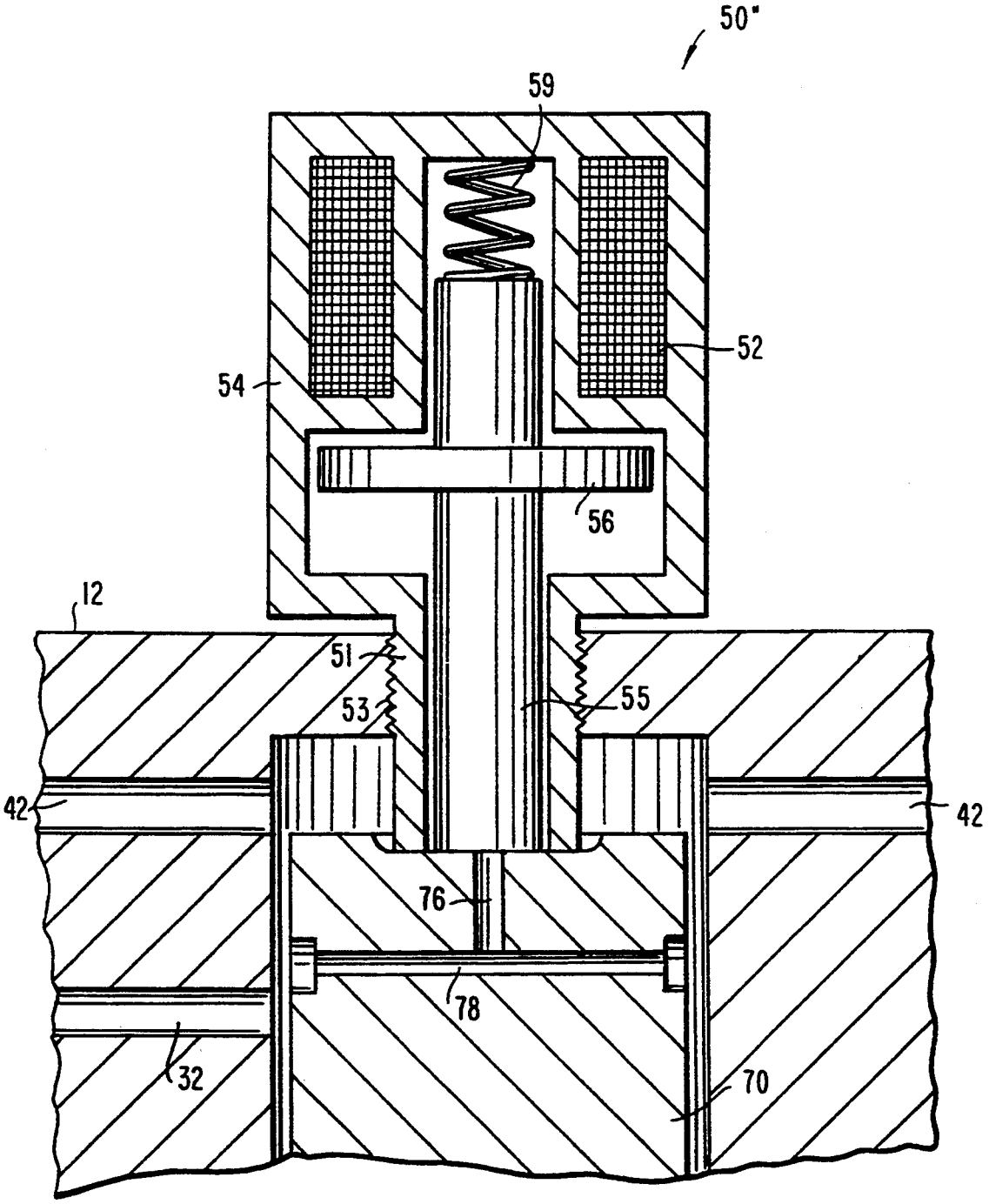
FIG. 7 is another view similar to FIGS. 5 and 6, but shows another alternative embodiment of the invention.

It will be understood that the foregoing is only illustrative of the principles of the invention, and that various modifications can be made by those skilled in the art without departing from the scope and spirit of the invention. For example, whereas in the embodiments shown in FIGS. 1–6 the solenoid pulls down on slave piston timing control element 55, FIG. 7 shows an alternative embodiment of a clip valve or reset mechanism 50'' (similar to mechanism 50' in FIGS. 4–6) in which control element 55 is pushed down by prestressed compression coil spring 59 and raised by passing electrical current through coil 52 when it is desired to terminate an exhaust valve opening event. In effect, the roles of the spring and solenoid in FIGS. 4–6 are reversed in FIG. 7.

The invention claimed is:

1. In a compression release engine brake for use with an internal combustion engine, said engine brake having a hydraulic circuit including a master piston reciprocable in a master piston bore and a slave piston reciprocable in a slave piston bore which is in hydraulic fluid communication with said master piston bore so that reciprocation of said master piston in said master piston bore causes hydraulic fluid to flow in said hydraulic circuit and reciprocate said slave piston in said slave piston bore, said master piston being reciprocated by a moving part of said engine, and said slave piston contacting a drive train of an exhaust valve of said engine during reciprocation of said slave piston to open said exhaust valve at a time when the engine would not otherwise open said exhaust valve, the improvement comprising:

a mechanical element at least partly disposed in said slave piston bore and mounted for movement relative to said slave piston bore; and electrically controlled means for selectively moving said mechanical element relative to said slave piston bore so that said mechanical element selectively contacts said slave piston in order to selectively modify said reciprocation of said slave piston in response to said reciprocation of said master piston.

2. The apparatus defined in claim 1 wherein said mechanical element comprises a rod substantially aligned with the axis of reciprocation of said slave piston and projecting into the hydraulic fluid in said slave piston bore which causes said slave piston to reciprocate.

3. The apparatus defined in claim 2 wherein said electrically controlled means selectively moves said rod substantially parallel to the axis of reciprocation of said slave piston in order to selectively change the amount by which said rod projects into the hydraulic fluid in said slave piston bore which causes said slave piston to reciprocate.

4. The apparatus defined in claim 3 wherein said electrically controlled means selectively moves said rod toward said slave piston in order to push said slave piston closer to said exhaust valve drive train prior to reciprocation of said master piston than said slave piston otherwise would be.

5. The apparatus defined in claim 3 wherein said rod selectively closes an aperture in said slave piston, said aperture allowing hydraulic fluid to escape from said hydraulic circuit when said aperture is not closed by said rod.

6. The apparatus defined in claim 5 wherein said electrically controlled means causes said rod to move with said slave piston to thereby keep said aperture closed until said slave piston has moved by a predetermined amount in the direction away from said electrically controlled means.

7. The apparatus defined in claim 6 wherein said electrically controlled means prevents said rod from moving with said slave piston beyond said predetermined amount of motion of said slave piston, thereby opening said aperture if said slave piston attempts to move substantially more than said predetermined amount and substantially preventing said slave piston from moving substantially more than said predetermined amount by allowing hydraulic fluid to escape from said hydraulic circuit via said aperture.

8. The apparatus defined in claim 7 wherein said electrically controlled means selectively retracts said rod from said slave piston in order to open said aperture and allow hydraulic fluid to escape from said hydraulic circuit via said aperture.

9. The apparatus defined in claim 3 wherein passing an electrical current through said electrically controlled means enables said electrically controlled means to extend said rod toward said slave piston.

10. The apparatus defined in claim 3 wherein passing an electrical current through said electrically controlled means causes said electrically controlled means to retract said rod away from said slave piston.

11. The apparatus defined in claim 1 wherein said electrically controlled means comprises an electromagnetic coil.

12. The apparatus defined in claim 1 wherein said electrically controlled means is adjustably mounted relative to said slave piston bore to permit adjustment of the movement of said mechanical element in response to said electrically controlled means.

* * * * *